US007050729B2

(12) United States Patent
Fujiwara

(10) Patent No.: US 7,050,729 B2
(45) Date of Patent: May 23, 2006

(54) IMAGE FORMING APPARATUS

(75) Inventor: Motohiro Fujiwara, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/935,187

(22) Filed: Sep. 8, 2004

(65) Prior Publication Data

US 2005/0063716 A1 Mar. 24, 2005

(30) Foreign Application Priority Data

Sep. 22, 2003 (JP) ..... 2003-330058

(51) Int. Cl.
*G03G 15/08* (2006.01)

(52) U.S. Cl. ..... 399/27; 399/30; 399/58; 399/62

(58) Field of Classification Search ..... 399/27
See application file for complete search history.

(56) References Cited

U.S. PATENT DOCUMENTS

| | | | | |
|---|---|---|---|---|
| 5,819,132 | A | 10/1998 | Hirobe | 394/49 |
| 2001/0055497 | A1* | 12/2001 | Hasegawa et al. | 399/58 |
| 2003/0021609 | A1* | 1/2003 | Yamaguchi et al. | 399/27 |
| 2003/0147661 | A1* | 8/2003 | Ogata | 399/58 |
| 2004/0091275 | A1* | 5/2004 | Matsuda et al. | 399/27 |
| 2004/0156648 | A1* | 8/2004 | Miyasaka et al. | 399/62 |
| 2004/0170440 | A1* | 9/2004 | Hirobe et al. | 399/27 |
| 2004/0184826 | A1* | 9/2004 | Ozawa et al. | 399/30 |

FOREIGN PATENT DOCUMENTS

| | | |
|---|---|---|
| JP | 9-22179 | 1/1997 |
| JP | 9-127780 | 5/1997 |

* cited by examiner

*Primary Examiner*—Arthur T. Grimley
*Assistant Examiner*—Ryan D. Walsh
(74) *Attorney, Agent, or Firm*—Fitzpatrick, Cella, Harper & Scinto

(57) ABSTRACT

An image forming apparatus includes a latent image forming portion for forming an electrostatic latent image corresponding to image information on an image bearing member, a developing portion, having a developer container for accommodating a developer containing a toner and a carrier, for developing the electrostatic latent image with the toner, and a toner density detecting portion for detecting a toner density in the developer container, a toner replenishment amount to the developer container being controlled in accordance with a result of detection by the toner density detecting portion, wherein a toner replenishment amount target value used for controlling the toner replenishment is controlled to fall within a restriction range, and the restriction range can be changed according to the image information.

5 Claims, 10 Drawing Sheets

IMAGE FORMING APPARATUS

BACKGROUND OF THE INVENTION

1. Field of the Invention

The present invention relates to an image forming apparatus utilized for a copying machine, a printer, FAX, etc. that involve using an electrophotographic system.

2. Related Background Art

FIG. 11 shows one example of the image forming apparatus.

There has been provided the image forming apparatus, wherein a developer supplied onto the surface of a developing sleeve 3 defined as a developer carrying member by developer agitation carrying means 11, 12, is held in a magnetic bead chain state by a magnetic force of a magnet roller 13, and is carried to a developing area of an opposite portion facing a photosensitive drum 40 defined as an image bearing member on the basis of a rotation of the developing sleeve 3, and the magnetic bead chain is scraped off by a return member 1 defined as a developer stay amount regulating member for regulating an amount of developer staying on the developing sleeve and by a blade 2 defined as a magnetic bead chain height regulating member, thereby properly maintaining an amount of developer carried to the developing area.

To describe it in greater detail, an interior of a developing device 44 is partitioned into a developing chamber 16 and an agitating chamber 17 by a partition wall 6 extending in a vertical direction, wherein the developing chamber 16 and the agitating chamber 17 accommodate a two-component developer containing a non-magnetic toner and a magnetic carrier.

A screw type of first and second developer agitation carrying means 11, 12 are, as described above, disposed in the developing chamber 16 and in the agitating chamber 17, respectively. The first agitation carrying means 11 agitates and thus carries the developer in the developing chamber 16. Further, the second agitation carrying means 12, under control of a developer density control device, agitates and carries the toners supplied to an upstream side of the second agitation carrying means 12 from a toner replenishment tank (unillustrated) and the developer already existing in the agitating chamber 17, and uniformizes the toner density. The partition wall 6 is formed with developer paths (unillustrated) through which the developing chamber 16 and the agitating chamber 17 communicate with each other at side end portions on this side and on a deep side as viewed in FIG. 11. Carrying forces of the first and second agitation carrying means 11 and 12 carry the developer in the developing chamber 16, of which a toner density decreases due to the toners being consumed for the development, into the agitating chamber 17 via the other path.

As shown in FIG. 11, the first screw type agitation carrying means 11 is disposed, substantially in parallel with a line-of-axis direction of the developing sleeve 3, i.e., with a development widthwise direction, in a bottom portion within the developing chamber 16. The first screw type agitation carrying means 11 takes a screw structure that a blade member is spirally provided around the axis of rotation, wherein the first agitation carrying means 11 rotates and thus carries the developer in the developing chamber 16 in one direction along the line-of-axis direction of the developing sleeve 3 in the bottom portion of the developing chamber 16. Further, the second screw type agitation carrying means 12 takes the same screw structure (that the blade member is spirally provided around the axis of rotation in a direction opposite to the first agitation carrying means 11) as the first screw type agitation carrying means 11 has. The second agitation carrying means 12 is disposed substantially in parallel with the first agitation carrying means 11 in a bottom portion within the agitating chamber 17, and rotates in the same direction as the first agitation carrying means 11 rotates and thus carries the developer in the agitating chamber 17 in a direction opposite to the first agitation carrying means 11. Thus, the developer is circulated between the developing chamber 16 and the agitating chamber 17 by dint of the rotations of the first and second agitation carrying means 11 and 12.

In this circulation of the developer, a toner density detection means 7 for detecting a toner density in the developer in order to detect a toner-to-carrier ratio is provided on this side (as viewed in FIG. 11) in a thrust direction in the vicinity of the developing sleeve 3 within the developing chamber 16. The reason why the toner density detection means 7 is provided not on a deep side but on this side is that if provided on the deep side (on an upstream side in the circulation of the developer in the developing chamber 16), it is impossible to detect a decrease in the toner density when the toner is consumed on a downstream side, however, if provided on this side, a detection position exists on the downstream side in the thrust direction in the developing chamber 16, and hence the decrease in the toner density is detected even when the toner is consumed everywhere in the thrust direction.

Even when the toner-to-carrier ratio of the developer is thus kept fixed, there is still a case where the density of a developed toner image might fluctuate due to deterioration of the carrier, an environmental change, a change in image of an original, etc.

Such being the case, a contrivance is proposed, wherein a patch image having a predetermined density is formed on a photosensitive drum, the density of the toner image is fixed by changing a target value of the toner-to-carrier ratio on the basis of a result of detecting a density of the patch image by a density detection means. This contrivance is disclosed in, e.g., Japanese Patent Application Laid-Open No. H09-022179.

Another contrivance is proposed, wherein for attaining stable toner density control even when whatever copy mode is set in a way that eliminates an undershoot and an overshoot of the toner density control which occur in a copy mode with a large variation in toner consuming amount, the toner is replenished based not on the signal from the toner density detection means 7 provided in the developing device 44 but on a video counter count if the density of the original changes over a predetermined value as compared with when copied last time on such an occasion that the image to be formed is switched over. This contrivance is disclosed in, e.g., Japanese Patent Application Laid-Open No. H09-127780.

In the contrivance (construction) disclosed in Japanese Patent Application Laid-Open No. H09-022179, however, it takes much time for the replenished toner to reach the toner density detection means 7 in the developing device, and consequently the toner replenishment amount has a ripple as shown in FIG. 12, with the result that the toner density largely deflects. In FIG. 12, the axis of ordinates indicates a toner amount that should be replenished according to the result of the detection by the toner density detection means, wherein a toner replenishing operation is not conducted in one direction. When the image density is switched over, the toner replenishment amount changes, thereby causing a much larger ripple. Further, even if noises enter the result of the detection by the toner density detection means 7 due to a developer volume density deflection, a contamination on the toner density detection means 7, etc, the toner replenishment amount becomes improper. In those cases, as shown in FIG. 13, the image density deflects or gets out of a normal state.

As proposed in Japanese Patent Application Laid-Open No. H09-127780, the above ripple can be slightly reduced by replenishing the toner on the basis of a result of the video counter count, however, a degree of this reduction was not sufficient.

SUMMARY OF THE INVENTION

It is therefore an object of the present invention to ensure a proper density transition and stability by gaining a proper and stable transition of a toner replenishment amount.

To accomplish the above object, an image forming apparatus includes latent image forming means for forming an electrostatic latent image corresponding to image information on an image bearing member, developing means for developing the electrostatic latent image with a toner, the developing means including a developer container for accommodating a developer containing the toner and a carrier, toner density detection means for detecting a toner density in the developer container, and control means for controlling a toner replenishment amount to the developer container in accordance with a result of detection by the toner density detection means, wherein the control means controls a toner replenishment amount target value used for controlling the toner replenishment so that this toner replenishment amount target amount falls within a restriction range, and is capable of changing the restriction range according to the image information.

DETAILED DESCRIPTION OF THE PREFERRED EMBODIMENTS

Embodiments of the present invention will hereinafter be exemplified.

First Embodiment

Figure 1:
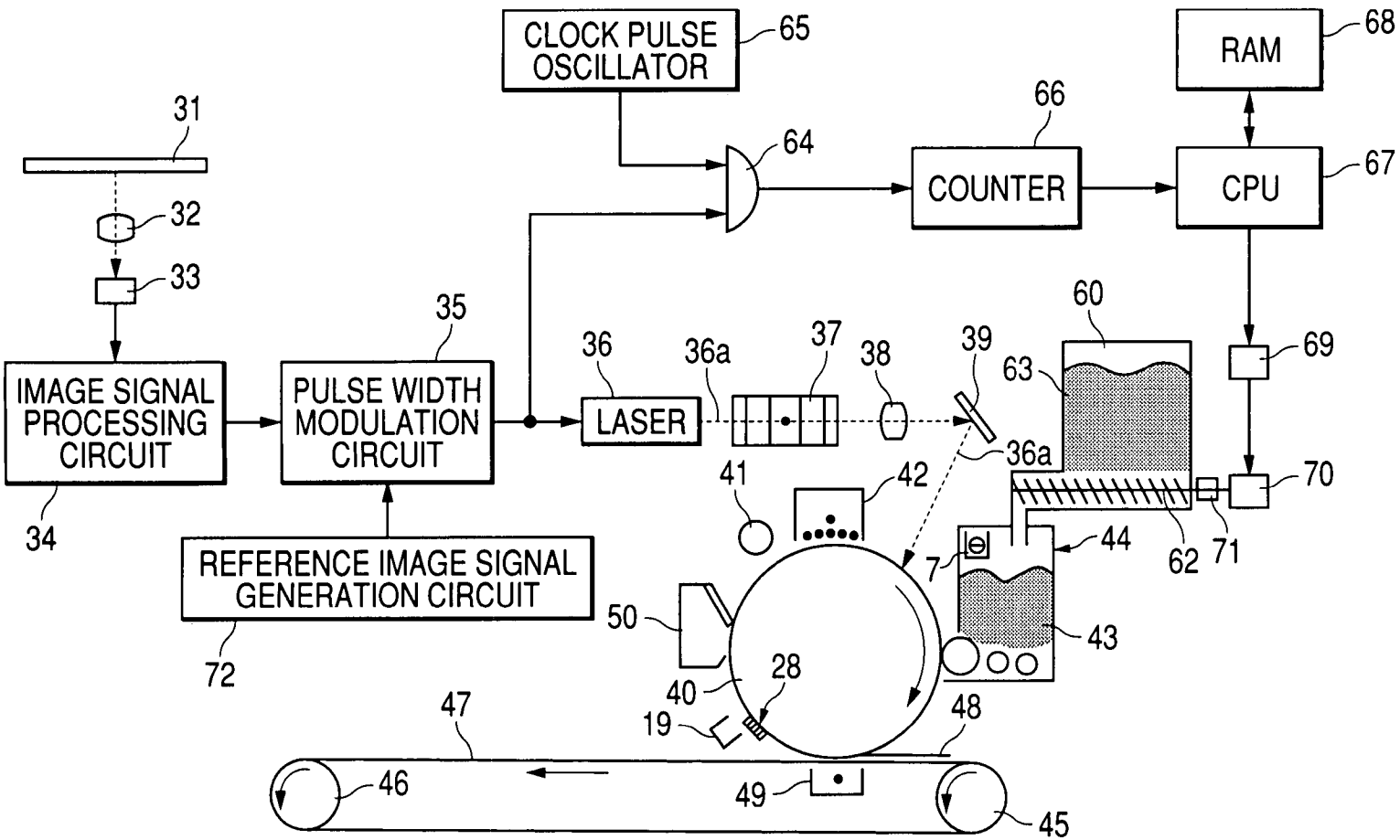
FIG. 1 is a schematic view of an image forming apparatus according to the present invention.

FIG. 1 is a schematic view of an electrophotographic type digital copying machine defined as an image forming apparatus using a developing apparatus in an embodiment of the present invention.

In the electrophotographic type digital copying machine, an image of an original 31 that should be copied is projected through a lens 32 on an image sensing element 33 such as a CCD, etc. The image sensing element 33 separates the image of the original into a multiplicity of pixels, and generates optical converting signals corresponding to densities of the respective pixels. Analog image signals outputted from the image sensing element 33 are transmitted to an image signal processing circuit 34. The image signal processing circuit 34 converts the analog image signals into pixel image signals having output levels corresponding to the densities of the pixels on a pixel-by-pixel basis, and the thus-converted pixel image signals are transmitted to a pulse width modulation circuit 35.

Figure 2A:
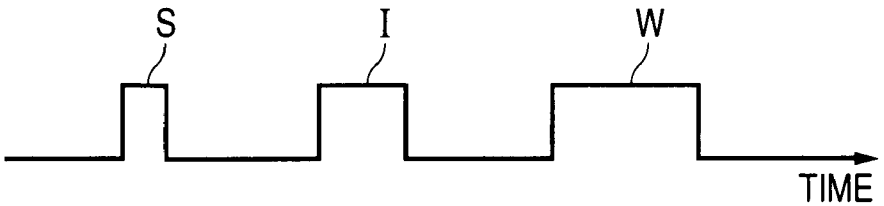
FIGS. 2A, 2B, 2C and 2D are explanatory diagrams of PWM control.
Figure 2B:
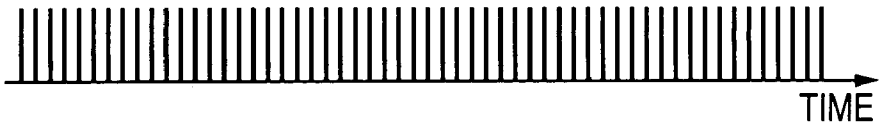
Figure 2C:
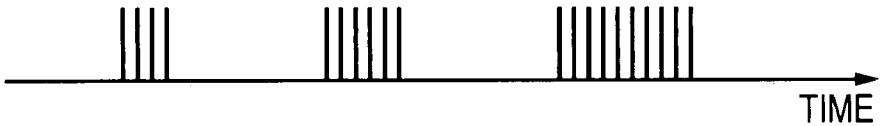

The pulse width modulation circuit 35 generates and outputs a laser drive pulse having a width (a time length) corresponding to the level for every pixel image signal inputted. To be specific, as shown in FIG. 2A, the pulse width modulation circuit 35 generates a drive pulse W having a larger width for the pixel image signal exhibiting a high density, a drive pulse S having a narrower width for the pixel image signal exhibiting a low density, and a drive. pulse I having an intermediate width for the pixel image signal exhibiting an intermediate density, respectively.

Figure 2D:
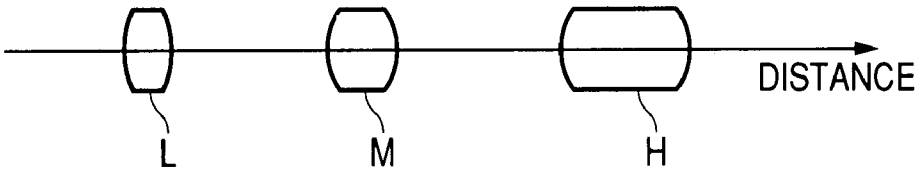

The laser drive pulse outputted from the pulse width modulation circuit 35 is supplied to a semiconductor laser 36, thereby causing the semiconductor laser 36 to emit a laser beam only for a period of time corresponding to a pulse width of this pulse. Accordingly, it follows that the semiconductor laser 36 is driven for a longer period of time for the high-density pixel and for a shorter period of time for the low-density pixel. Therefore, a photosensitive drum 40 defined as an image bearing member is, through an optical system that will be explained next, exposed to the light over a longer range in a main scan direction with respect to the high-density pixel and exposed to the light over a shorter range in the main scan direction with respect to the low-density pixel. Namely, an electrostatic latent image having a different dot size corresponding to the density of the pixel is formed based on the image density information of the original. Accordingly, as a matter of course, a toner consumption amount for the high-density pixel is larger than the amount for the low-density pixel. Note that the symbols L, M and H in FIG. 2D represent the electrostatic latent images of the low-, intermediate- and high-density pixels, respectively.

It is to be noted that the image forming apparatus according to the present invention has, in addition to the original copying function, a printer function of forming, on a recording material such as paper, etc., the image transmitted from a personal computer connected via a network cable to the image forming apparatus, and a facsimile function as well. Namely, the present image forming apparatus is capable of forming the image based on the image density information other than the paper original.

A laser beam 36*a* emitted from the semiconductor laser 36 is swept through a rotational polygon mirror 37 and forms a spot-image on the photosensitive drum 40 via a lens 38 such as an f/θ lens, etc. and via a fixed mirror 39 for directing the laser beam 36*a* toward the photosensitive drum 4 as the image bearing member. Thus, the laser beam 36*a* scans the drum 40 in the direction (the main scan direction) substantially parallel with an axis of rotation of a rotational drum of the photosensitive drum 40, thereby forming the electrostatic latent image.

The photosensitive drum 40 is an electrophotographic photosensitive member having, on its surface, a photosensitive layer of amorphous silicon, selenium, OPC, etc. and rotating in an arrowhead direction. The photosensitive drum 40 is, after electric charges on the drum 40 have been uniformly eliminated by a pre-exposure device 41, uniformly charged by a primary charger 42. Thereafter, the photosensitive drum 40 is exposed to and scanned by the laser beam modulated corresponding to the aforementioned image-information signal, thereby forming an electrostatic image corresponding to the image signal. This electrostatic latent image is subjected to reversal developing by a developing device using a two component developing agent with a mixture of toner particles and carrier particles, thereby forming a visible image (toner image). Note that the reversal developing is defined as a developing method of visualizing the latent image by adhering toners electrified with the same polarity as that of the latent image to an exposed-to-the-light area on the photosensitive member. The reference numeral 60 designates a hopper for accommodating the toners, 62 represents a replenishment screw for replenishing the toners to a developer container, and 70 denotes a drive motor. The toner image is transferred by an operation of a transfer charger 49, onto a transferring material 48 held on a transferring material holding belt 47 looped around two pieces of rollers 45, 46 and endlessly driven in an arrowhead direction in FIG. 1.

The transferring material 48 onto which the toner image has been transferred is separated from the transferring material holding belt 47, then conveyed to an unillustrated fixing device and fixed as an permanent image. Further, residual toners left on the photosensitive drum 40 after the transfer are removed by a cleaner 50 afterward.

Note that only a single image forming station (including the photosensitive drum 40, the primary charger 42, the developing device 9, etc.) is illustrated for simplifying the description. In the case of a color image forming apparatus, however, image forming stations for respective colors such as cyan, magenta, yellow and black are disposed above the transferring material holing belt 47 sequentially in the moving direction of the belt 47. The electrostatic latent images assuming the respective colors, into which the image of the original is color-separated, are sequentially formed on the photosensitive drums of the image forming stations. The electrostatic latent images are developed by the developing devices containing the corresponding color toners and sequentially transferred onto the transferring material 48 held and conveyed by the transferring material holding belt 47.

Next, a developing device 44 will be explained.

Figure 3:
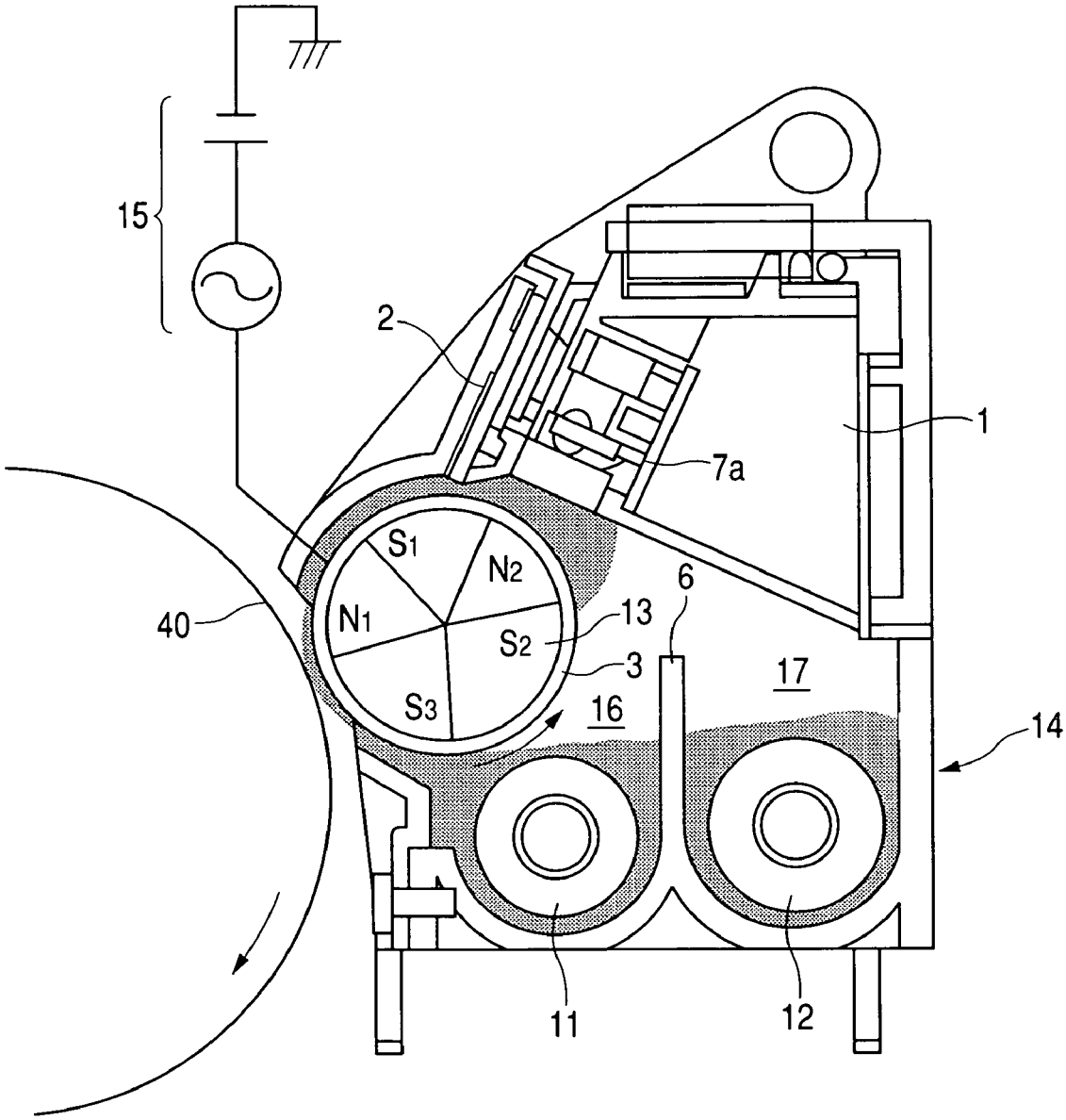
FIG. 3 is a sectional view of a developing device in an embodiment of the present invention.

As shown in FIG. 3, the two-component developing device 44 disposed as opposed to the photosensitive drum 40 includes a developing sleeve 3 serving as a developer carrying member, an agent (developer) return member 1 for regulating an amount of the developer attracted up to a magnetic bead chain delimiting position from a supply position of the developer, a blade 2 serving as a magnetic bead chain height regulating member of the developer, and a toner density detection means 7*a* for detecting a toner density of the two-component developer.

The developer container of the developing device 44 is partitioned into a developing chamber 16 and an agitating chamber 17 by a partition wall 6 extending in a vertical direction. An upper portion above the partition wall 6 has an open space via which an extra of the two-component developer in the developing chamber 16 is collected into the agitating chamber 17. The developing chamber 16 and the agitating chamber 17 accommodate the two-component developer containing a non-magnetic toner and a magnetic carrier.

A screw type of first and second developer agitation carrying means 11, 12 are disposed in the developing chamber 16 and in the agitating chamber 17, respectively. The first agitation carrying means 11 agitates and thus carries the developer in the developing chamber 16. Further, the second agitation carrying means 12, under control of a developer density control device, agitates and carries the toners supplied to an upstream side of the second agitation carrying means 12 from a toner replenishment tank (unillustrated) and the developer already existing in the agitating chamber 17, and uniformizes the toner density. The partition wall 6 is formed with developer paths (unillustrated) through which the developing chamber 16 and the agitating chamber 17 communicate with each other at side end portions on this side and on a deep side as viewed in FIG. 1. Carrying forces of the first and second agitation carrying means 11 and 12 carry the developer in the developing chamber 16, of which the toner density decreases due to the toners being consumed for the development, into the agitating chamber 17 via the other path.

The developing chamber 16 of the developing device 44 is formed with an opening portion in a position corresponding to the developing area facing the photosensitive drum 40. The developing sleeve 3 is rotatably disposed so as to be partly exposed to this opening portion. The developing sleeve 3 is composed of a non-magnetic material and rotates in an arrowhead direction when operating for the development, and a magnet 13 defined as a magnetic field generation means is fixed inside this sleeve 3. The developing sleeve 3 bears and carries the two-component developer layer of which thickness is regulated by the blade 2, and supplies the developer to the photosensitive drum 40 in the developing area facing the photosensitive drum 40, thereby developing the latent image. At this time, a developing bias voltage into which a DC voltage and an AC voltage are superimposed is applied to the developing sleeve 3 from a power source 15 in order to improve a developing efficiency, i.e., an adding rate of the toners to the latent image on the photosensitive drum.

The magnet 13 in the first embodiment has a development magnetic pole N1 and magnetic poles S1, N2, S2 and S3 for carrying the developer. Further, the blade 2 is composed of a non-magnetic material such as aluminum (Al), etc. and is disposed more upstream in the rotating direction of the developing sleeve 3 than the photosensitive drum 40. The blade 2 regulates the thickness of the developer (layer) carried to the developing area along on the developing sleeve 3 by adjusting a gap between the surface of the developing sleeve 3 and the blade 2 itself. Accordingly, in the first embodiment, both of the non-magnetic toners and the magnetic carriers are carried to the developing area through between a front end portion of the blade 2 and the developing sleeve 3.

The first screw type agitation carrying means 11 is disposed, substantially in parallel with a line-of-axis direction of the developing sleeve 3, i.e., with a development widthwise direction, in a bottom portion within the developing chamber 16. In the first embodiment, the first screw type agitation carrying means 11 takes a screw structure that a blade member is spirally provided around the axis of rotation, wherein the first agitation carrying means 11 rotates and thus carries the developer in the developing chamber 16 in one direction along the line-of-axis direction of the developing sleeve 3 in the bottom portion of the developing chamber 16. Further, the second screw type agitation carrying means 12 takes the same screw structure (that the blade member is spirally provided around the axis of rotation in a direction opposite to the first agitation carrying means 11) as the first screw type agitation carrying means 11 has. The second agitation carrying means 12 is disposed substantially in parallel with the first agitation carrying means 11 in a bottom portion within the agitating chamber 17, and rotates in the same direction as the first agitation carrying means 11 rotates and thus carries the developer in the agitating chamber 17 in a direction opposite to the first agitation carrying means 11. Thus, the developer is circulated between the developing chamber 16 and the agitating chamber 17 by dint of the rotations of the first and second agitation carrying means 11 and 12.

The developer in the developing chamber 16 is carried on the developing sleeve 3 by action of the magnet 13 built in the developing sleeve 3, and is carried to the developing area in a way that regulates the layer thickness of the developer by use of the blade 2. The developer, which has been unused for the development in the developing area and thus left, is again carried back to the developing chamber 16 by the developing sleeve 3. The residual developer is scraped off the developing sleeve 3 by the repulsive magnetic poles S3 and S2 and thus collected into the developing chamber 16.

On the other hand, the developer agitated and carried as the first agitation carrying means 11 rotates is attracted up toward the developing sleeve 3 by one magnetic pole S2 of the repulsive magnetic poles. The developer is, when being attracted up, attracted with the aid of the developer return member 1, and the amount of the developer carried to the developing sleeve 3 is regulated to some extent.

The developer attracted up by the magnetic pole S2 is carried to the blade portion by a magnetic restraint force formed by a magnetic field given from a next magnetic pole N2, acting in a central direction of the developing sleeve 3 and determined according to the amount of the developer regulated by the developer return member 1, and by a carrying force acting in the rotating direction of the developing sleeve 3.

Then, the developer return member 1 incorporates the toner density detection means 7*a* for detecting the toner density of the developer in order to detect a toner-to-carrier ratio in a position facing the developing sleeve 3 between the magnetic pole S2 and the magnetic pole N2 midway of being carried to the bale portion form the attract-up position of the developer.

Figure 4:
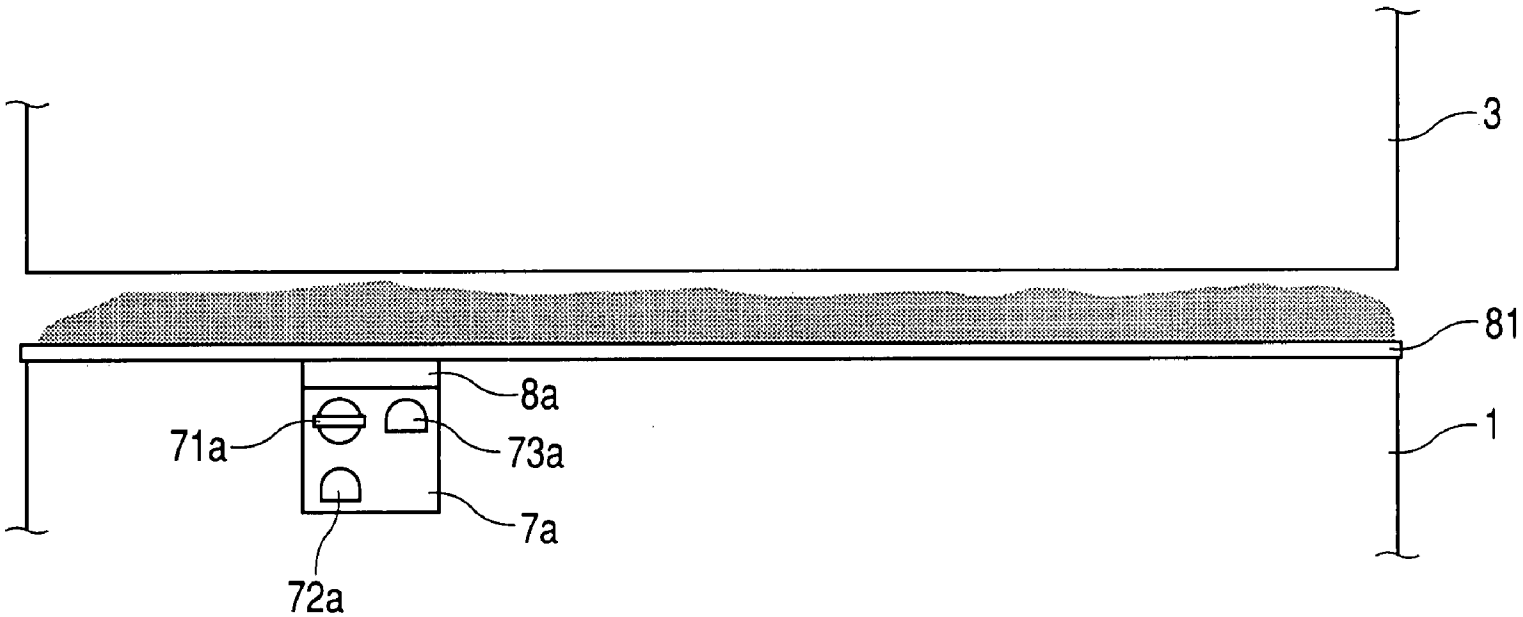
FIG. 4 is a diagram showing how a toner density detection sensor is disposed.

As shown in FIG. 4, the toner density detection means 7*a* in the first embodiment takes a developer reflection system constructed of a bidirectional emission LED 71*a*, a reference light receiving element 72*a*, a reflection light receiving element 73*a* and a detection window 8*a*. Then, the detection window 8*a* is formed of a transparent acrylic resin, wherein an FEP (fluorinated ethylene propylene) sheet 81 serving as a mold release property resin is pasted to a detection surface facing the developer in a way that covers the detection surface in order to prevent the toner adhesion.

The non-magnetic toner used in the first embodiment involves the use of a toner having an average particle size of 5–11 μm, which is acquired by dispersing 5–15 wt % of a coloring pigment and further a metal chain substance (coordination compound) of alkyl substitution salicylic acid as a negative charge control agent into 80–90 wt % of a polyester resin. This toner is used by extraneously adding 0.2–2 wt % of titanium oxide $TiO_2$ thereto. The extraneous additive may involve using silica other than titanium oxide.

Further, an arbitrary ferrite carrier, especially sintered ferrite particles are used as the magnetic carrier. Namely, a core material involves using Zn series ferrite, Ni series ferrite, Cu series ferrite, Mn—Zn series ferrite, Mn—Mg series ferrite, Cu—Zn series ferrite, Ni—Zn ferrite and so on, and this core material is coated with 0.5–2 wt % of the acrylic resin for the purpose of improving frictional electrostatic property, environment stability and durability, whereby the carrier having an average particle size of 30–60 μm is used as the magnetic carrier. A polyester resin, a fluororesin, a silicon resin, etc. other than the above can be properly selectively used as the coating agent.

Herein, the toner density detection means of the developing device will be described. The toner density detection means (71*a* in FIG. 4) is provided on this side in a thrust direction within the developer container. The developer density detection means 71*a* is contrived to maintain the stability of the toner density in such a way that the light receiving element 73*a* monitors a reflection amount of infrared-rays reflected from the developer when the developer density detection means 71*a* irradiates the developer within the developer container with the infrared-rays by utilizing a characteristic that the toner in the two-component developer reflects the infrared-rays while the carrier absorbs the infrared-rays, and calculates the toner density of the two-component developer, and then the toner is replenished.

A toner replenishment density is controlled such that, to start with, the two-component developer is inputted into the developer container, an output "Sig-init" from the light receiving element 73*a* based on the light amount of the reflection from the two-component developer in an unused state is measured, and this value as a target value is stored on a memory. Then, when the two-component developer starts being consumed upon a start of copying, an output "Sig-cur" from the light receiving element 73*a* based on the light amount of the reflection from the two-component developer at that time is measured for every copy. Then, a difference "Asig" from the "Sig-init" stored on the memory is calculated.

$$\Delta sig=(Sig\text{-}init)-(Sig\text{-}cur) \quad (1)$$

A deviation amount "ΔD" from an initial toner density at that time is calculated from the formula (1) and from an output sensitivity value "rate" per pre-measured-toner density 1 wt % fluctuation.

$$\Delta D=\Delta sig/rate \quad (2)$$

The toner amount of the toner replenished into the developer container is determined based on the calculated value of "ΔD". Namely, if the deviation amount from the initial toner density shows a minus value, the toner amount that meets the deviation amount is replenished. Whereas if the deviation amount shows a plus value, the replenishment is stopped. For example, when ΔD=−1 wt %, the toner corresponding to 1 wt % is replenished. When ΔD=+1 wt %, none of the toner is replenished. The toner replenishment density is thus controlled to maintain the initial toner density.

Next, an image density detection means 19 will be explained.

The image density detection means 19 is provided posterior to the transfer member 49 in a way that faces the photosensitive drum 40 as well as after the development stage in the image forming apparatus as in FIG. 1. The image density detection means 19 has the same structure as the aforementioned developer density control means. The image density detection means 19 is, as shown in FIG. 4, constructed of the bidirectional emission LED 71*a*, the reference light receiving element 72*a*, the reflection light receiving element 73*a* and the detection window 8*a*. Then, the FEP sheet 81 for preventing the toner adhesion is pasted to the detection surface. With this configuration, a reflection density of a patch image 28 on the photosensitive drum 40 is detected.

Figure 5:
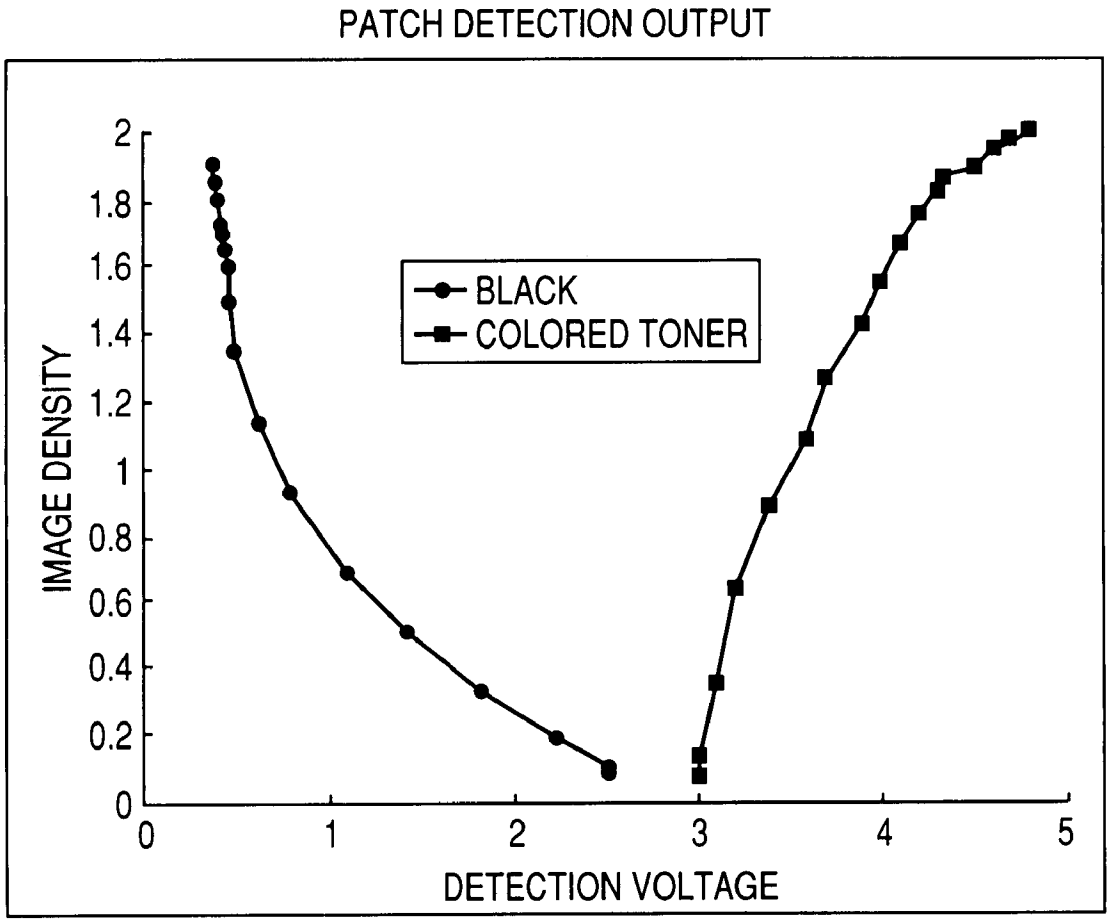
FIG. 5 is a graph showing an output of a detection density versus an image density.

In the electrophotographic copying machine, the image density changes depending on a charge amount of the toner on the developing sleeve 3. In the electrophotographic copying machine using the two-component developing device, the image density becomes higher as the charge amount of the toner per unit weight gets smaller. It is because, if under the same conditions of charging, exposing and so forth, the charge amount for developing on the photosensitive drum 40 is determined, and consequently a larger amount of toner is used for the development as the charge amount per unit weight becomes smaller. It is required for making the image density fixed that the charge amount of the toner per unit weight be fixed, however, it is difficult to sequentially detect and control the charge amount of the toner. Such being the case, the image density on the photosensitive drum 40 is detected, the toner density is controlled so that the image density becomes fixed, and the toner charge amount per unit weight and the image density are set fixed. The image density detection means 19 shows detection outputs as plotted by a curve B in FIG. 5 with respect to the toners in magenta, cyan and yellow (which will be termed colored toners) and detection outputs as plotted by a curve A in FIG. 5 with respect to a black toner versus the image densities on the photo sensitive drum.

According to the first embodiment, a density of a patch image 28 is calculated (patch detection ATR) based on the image density detection means, and an excessive or insufficient toner amount acquired therefrom is subjected to feedback to a present toner density obtained from the toner reflection ARR, thereby changing the toner density and controlling the density to the fixed value so that the charge amount of the toner per unit weight becomes fixed. Generally, when the toner density of the developer rises, the image density becomes rich. The reason for this is that a contact chance between the toner and the carrier decreases, and hence the toner charge amount per unit weight is reduced. The following is the specific control. It is assumed that the toner density of the initial developer be 6 wt % (the magnetic carrier of 470 g plus the toner of 30 g). The toner is replenished based on the output of the toner density detection means 7*a* so that the toner density comes to 6 wt %. In this state, the patch detection ATR is conducted, wherein it proves that the image density is lower than the initial density. Supposing that the toner of 5 g be, it is judged, needed for the feedback to the initial density, it is considered that the toner density is in a state of being −1 wt %. Accordingly, a target value of the toner density is changed to 7 wt % from 6 wt %, and it is possible to converge at a certain fixed image density level by performing the toner density control on the basis of the above-target value from this onward.

The toner replenishment is controlled based on the detection by the toner density detection means 7*a*, thereby exhibiting comparatively a good density transition when consecutively copying the specified image and copying images in mixture of which the image densities do not largely differ.

Figure 13:
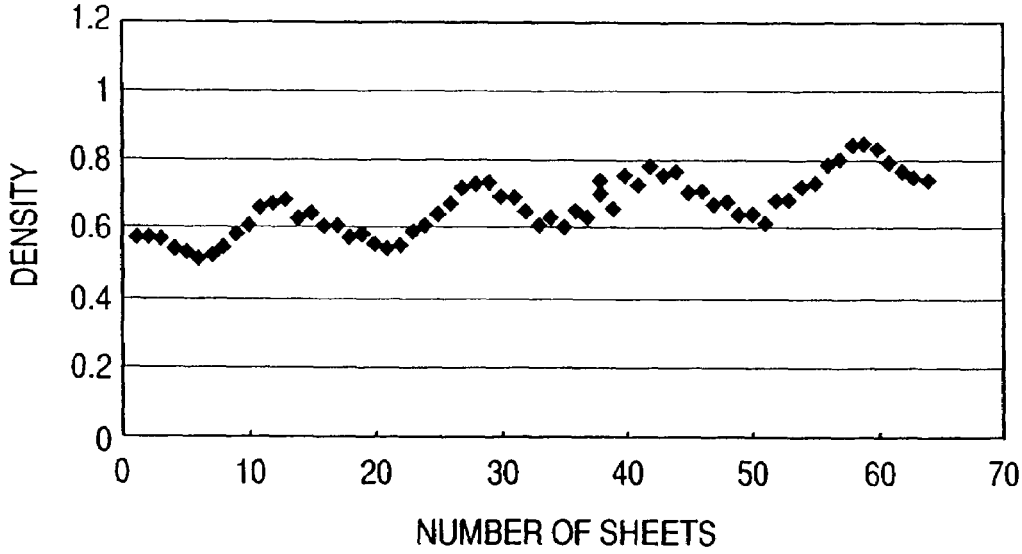
FIG. 13 PRIOR ART
FIG. 13 is a graph showing a density transition immediately after the density of the original becomes thick in the conventional image forming apparatus.

When a difference in image area size rate is large, however, if shifted to consecutive copying of 70% image (178/255 gradation level) from the consecutive copying of the original having a difference of, e.g., 50% or larger, for instance, from the consecutive blank copying, the image density becomes gradually rich while showing a deflection with a 15-sheet period as illustrated in FIG. 13. At this time, the toner density was changed at an interval of 33 sheets as a toner density target change value under the patch detection ATR control.

The following is elucidation of a reason why such a density transition is exhibited.

Figure 12:
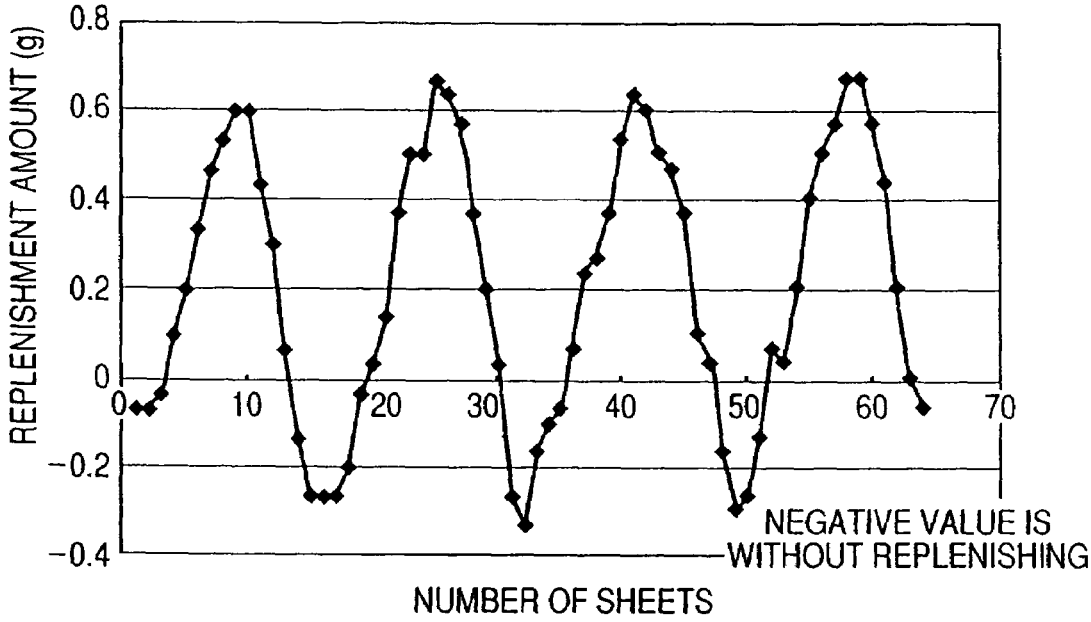
FIG. 12 PRIOR ART
FIG. 12 is a graph showing a toner replenishment transition immediately after the density of the original becomes thick in the conventional image forming apparatus.

Immediately after a copy of the original with a high density has been started, the toner density detection means 7*a* does not output a replenishment signal corresponding to a consumption amount of the high-density original but, a bit later on, outputs the replenishment signal corresponding to the consumption amount of the solid-black original, resulting in an under-replenishment state for a short while. At that time, the toner density decreases to a great degree and comes to a thin density state. Thereafter, more of the toner replenishment signal is outputted in order to restore (increase) the thus-reduced toner density. The toner density becomes proper after copying several sheets, and the toner density detection means 7*a* outputs the replenishment signal corresponding to the original consumption amount. Much of the toner replenished before the several sheets, however, reaches the developing sleeve 3 with a delay. Therefore, an over-replenishment state occurs for a short while this time, wherein the toner density rises and becomes thick. A repetition of this process leads to the density transition with a certain period. FIG. 12 shows a toner replenishment amount transition at that time. The replenishment amount transition has a similar period. This period is determined by a time constant based on a distance between the toner density detection means 7*a* and the replenishment screw 62. On the other hand, amplitudes of the density deflection and of the replenishment amount deflection are, though determined by a change amount of the original density, affected by, other than this, a change in behavior of the toner in the vicinity of the toner density detection means 7*a*.

As the original density changes, the toner replenishment amount changes or has the deflection, whereby the behavior of the toner in the vicinity of the toner density detection means 7*a* changes or has the deflection. The toner density control is affected by a toner contamination on the detection surface of the detection window 8*a*. When the toner is excessively replenished, a large amount of new toner exists on the detection window 8*a*. Polishing powder, i.e., titanium oxide in the first embodiment is extraneously added to the toner. The new toner properly contains the polishing powder capable of scraping off the toner contamination by adequately polishing the detecting window 8*a*. Accordingly, when much of the new toner exists, the toner density can be properly detected. While on the other hand, a durable toner, of which the polishing power is embedded in the toner or migrates to the photosensitive drum 40 with the result that an amount of the polishing powder decreases, has therefore a less capability of removing the contamination on the detection window 8*a* and is easy to produce the toner contamination on the detection surface of the detection window 8*a*. When in the under-replenishment, much of the durable toner exists in the vicinity of the detection window 8*a* and is easy to contaminate the window 8*a* with the toner. When the toner contamination is produced, it follows that the toner density is mistakenly detected to be high, and therefore the toner replenishment is stopped. With this stoppage, the toner replenishment becomes far less, whereby the toner density decreases and gets thin. This causes, as shown in FIGS. 12 and 13, extremely a large density deflection and a large replenishment amount deflection.

Note that conversely in the case of changing to the consecutive copying of the thin image from the thick image, a balance of the toner replenishment is lost just after the change, an excessive amount of toner is replenished to the developing chamber 16 from the agitating chamber 17. Therefore, the toner density starts being excessive from an inner side of the developing chamber 16, and the developer is carried to the portion, on this side as viewed in the Figure, of the developing chamber 16. Then, the maximum replenishment continues till this is detected by the toner density detection means 7*a*, which triggers the occurrences of the density deflection and of the replenishment amount deflection.

During the occurrence of the density deflection as described above, the patch detection ATR control might get improper. This will be elucidated by exemplifying the density transition in FIG. 13. There is seen a tendency that the density gradually becomes thick as it is just after being changed to the thick image. Although it is essential that this thick density is modified under the patch detection ATR control, an amplitude of the density shows the minimum value at an operation timing (the 34th sheet this time) of the patch detection ATR control. Hence, the patch detection ATR control can not detect that the density becomes thick, and the density gets much thicker hereafter.

Such being case, the present invention uses not only toner replenishment control (which will hereinafter be referred to as developer reflection ATR) based on the detection signal of the aforementioned toner density detection means 7*a* but also a combination with toner replenishment control (which will hereinafter simply be called video count ATR) by a toner replenishment means 63 on the basis of the video count, thereby preventing the under-replenishment and the over-replenishment by estimating an exact and necessary toner amount and also attaining the proper density transition with no density deflection. Owing to this, the patch detection ATR control is adequately performed, and the permanent density transition is stabilized. The toner replenishment control according to the present invention will hereinafter be discussed.

Figure 6:
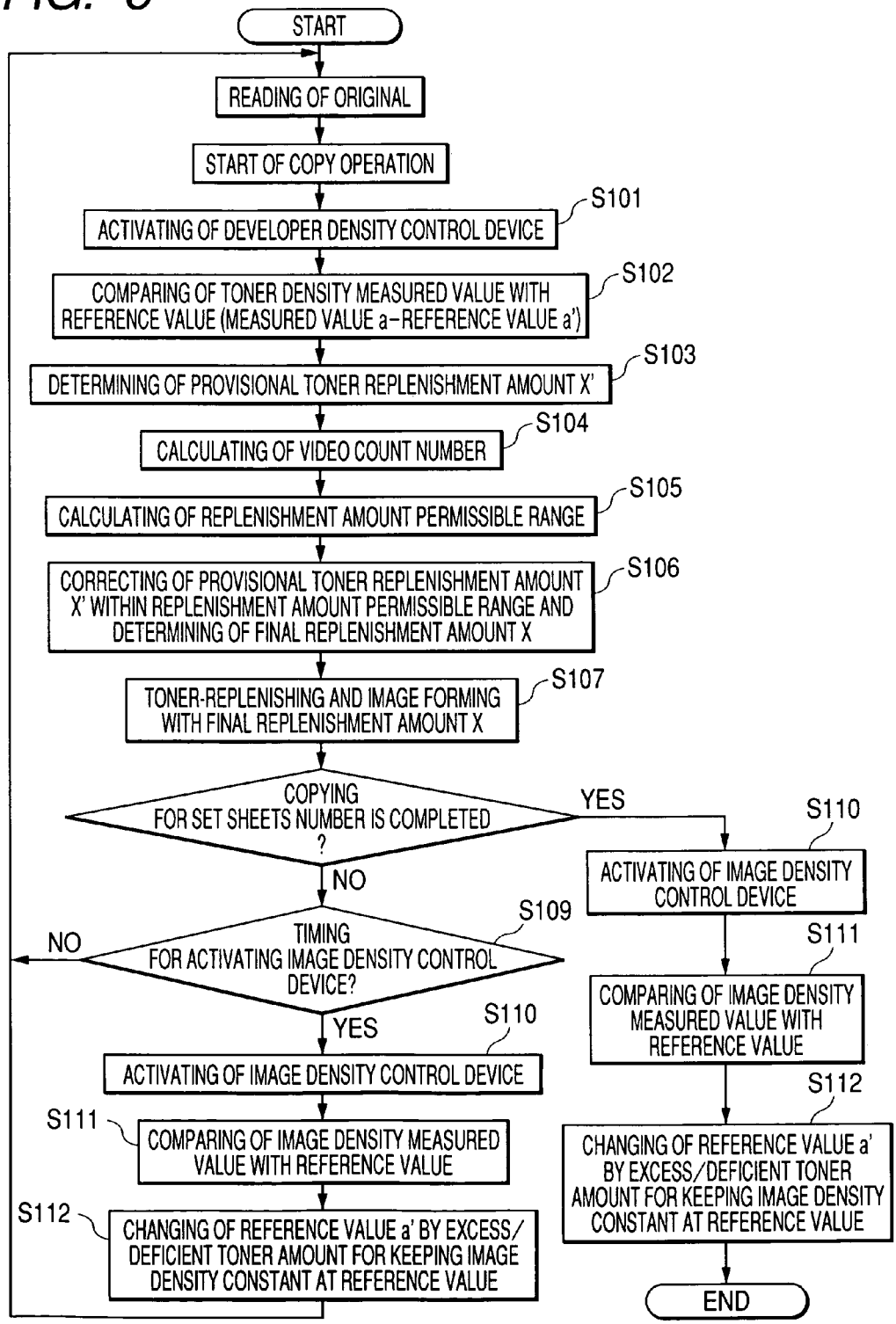
FIG. 6 is a flowchart in the embodiment of the present invention.

FIG. 6 shows a flowchart in the first embodiment.

Figure 7:
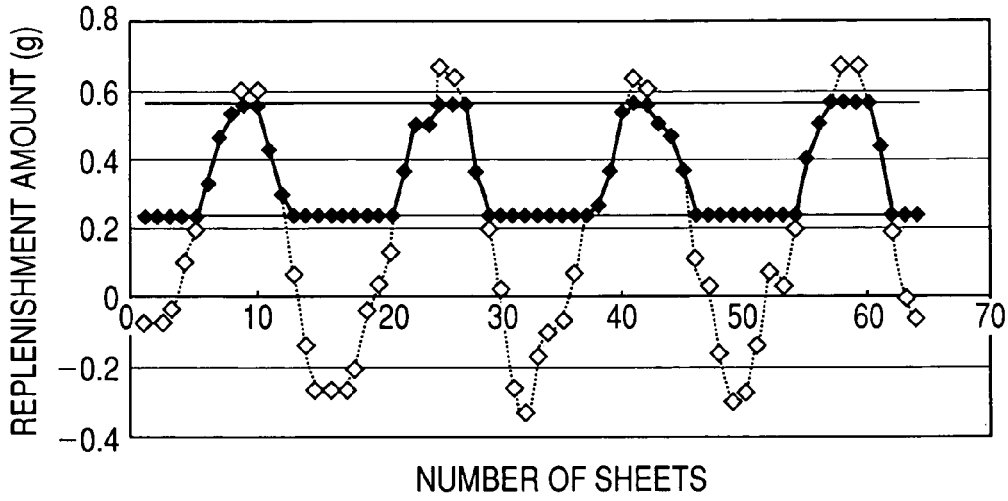
FIG. 7 is a graph schematically showing toner replenishment amount control in the embodiment of the present invention.
Figure 8:
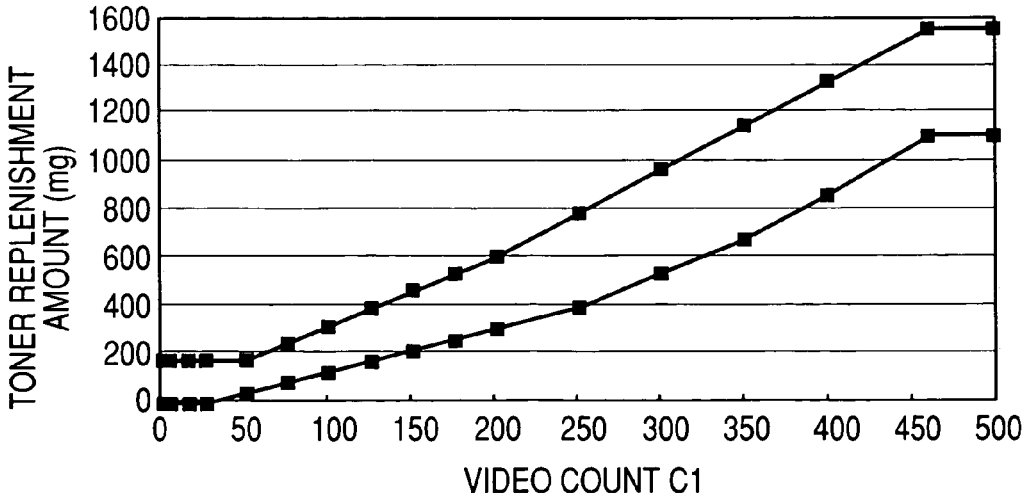
FIG. 8 is a graph showing a relationship between a video counter C1 and a possible-of-replenishing amount range in the embodiment of the present invention.

According to the first embodiment, upon a start of the copy operation, to begin with, the toner density detection means 7*a* detects the toner density on the developing sleeve 3 in S101. Next in S102, a difference between a target toner density and a toner density at the present time is obtained by the formula (1) given above. Subsequently in S103, a provisional toner replenishment amount x' is obtained by the aforementioned formula (2). Next in S104, an area size amount of the image of the original is calculated from a video count C1. Subsequently, upper and lower limits of the toner replenishment amount are determined in S105 by use of a control table as shown in FIG. 8. Subsequently in S106, the provisional toner replenishment amount X' is modified within the upper and lower limits of the toner replenishment amount obtained in S105, thereby acquiring a final toner replenishment amount x. The way of modifying within the upper and lower limits according to the first embodiment is that the provisional toner replenishment amount is, if equal to or larger than the upper limit, modified to the upper limit value and, if equal to or smaller than the lower limit, modified to the lower limit value, and further, if within the upper and lower limits, remains as it is. FIG. 7 shows an example. A thin line represents the provisional toner replenishment amount x', wherein the line in the vicinity of 0.2 g and the line in the vicinity of 0.6 g show the upper and lower limits. A replenishment amount as indicated by a solid line is acquired by modifying the thin line x' so as to fall within the upper and lower limits.

Next, in S107, the toner is replenished by X(g) during the image formation. Subsequently, it is checked in S108 whether or not a set number of prints are completed. When completed, the image density detection means 19 detects the density on the photosensitive drum 40. Next in S110, a density reference value determined at the initial stage is compared with the present density. Subsequently in S112, a toner density reference value a' is changed for restoring the difference, and the copy operation is finished. When in S108, if the set number of prints are not yet completed, it is checked whether or not it is a timing of activating the image density detection means 19. Note that the image density detection means 19 is activated once for every 56 sheets of small-sized paper such as A4-sized paper, etc. and activated once for every 34 sheets of large-sized paper such as A3-sized paper, etc. in the first embodiment. Then, if not at the operation timing, the copying continues for the next paper. If at the operation timing, the image density detection means 19 is activated as described above, the toner density reference value a' is changed, and thereafter the copy operation for the remaining paper is performed.

The following is a detailed explanation about the control in S104 and in S105.

In S104, the image area size amount of the original is calculated from the video count C1 integrated by a counter 66 in FIG. 1. The image area size amount is obtained by a proportional calculation, wherein the video count of the solid image (at a 255/255 gradation level) having a size given by 12 inch×18 inch (12 inch is the possible-of-letting-the-paper-through maximum size in the image forming apparatus) is set to 500. For example, in the case of a uniform halftone image at a 128/255 gradation level on a sheet of paper having a (12 inch×9 inch) size, the image area size amount becomes 125. At this time, supposing that the toner amount needed for forming the image is proportional to the image area size amount, the toner amount required for on this sheet surface can be uniquely obtained. When the toner amount needed for a solid black copy in, e.g., a (12 inch×18 inch) size is 1.0 g, the toner amount required for the halftone image described above becomes 0.25 g.

It is considered desirable that the toner be replenished according to a toner amount (which will hereinafter be termed DTOTAL) needed throughout the sequence obtained herein. It is, however, undesirable that the toner replenishment continues in accordance with DTOTAL at all times. In the case of continuing the replenishment according to DTOTAL, the toner density on the developing sleeve 3 becomes fixed. The toner replenishment amount, however, changes in accordance with the image area size rate of the original, and, with this change, a charge amount per unit weight of the toner changes, whereby development efficiency varies. To be specific, the toner density on the developing sleeve 3 is required to properly change so that the patch image 28 on the photosensitive drum 40 becomes uniform.

Hence, the required toner amount obtained from the video count C1 is given a width, thereby acquiring a replenishment amount permissible range. FIG. 8 shows this replenishment amount permissible range.

In this replenishment amount permissible range, with respect to an ideal replenishment amount obtained from the video count C1, approximately +20% is set as an upper limit, while a lower limit is set to −40%. These upper and lower limits are determined based on the electrostatic properties of and a contact probability between the toner and the carrier but are not restricted to those values. When the image density changes and so on, the replenishment amount permissible range is designed to get broader to properly change the toner density on one hand and is also designed to get narrower to reduce a scatter in the replenishment amount on the other hand. Those limit values are acquired as a result of thus designing the replenishment amount permissible range.

Figure 9:
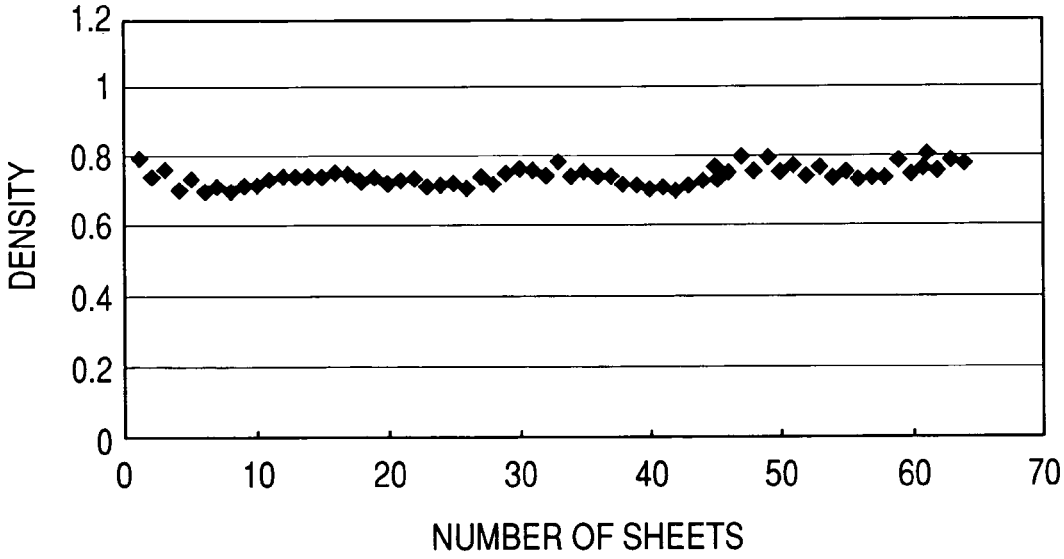
FIG. 9 is a graph showing a density transition immediately after a density of an original becomes thick in a case where the present invention is applied.
Figure 10:
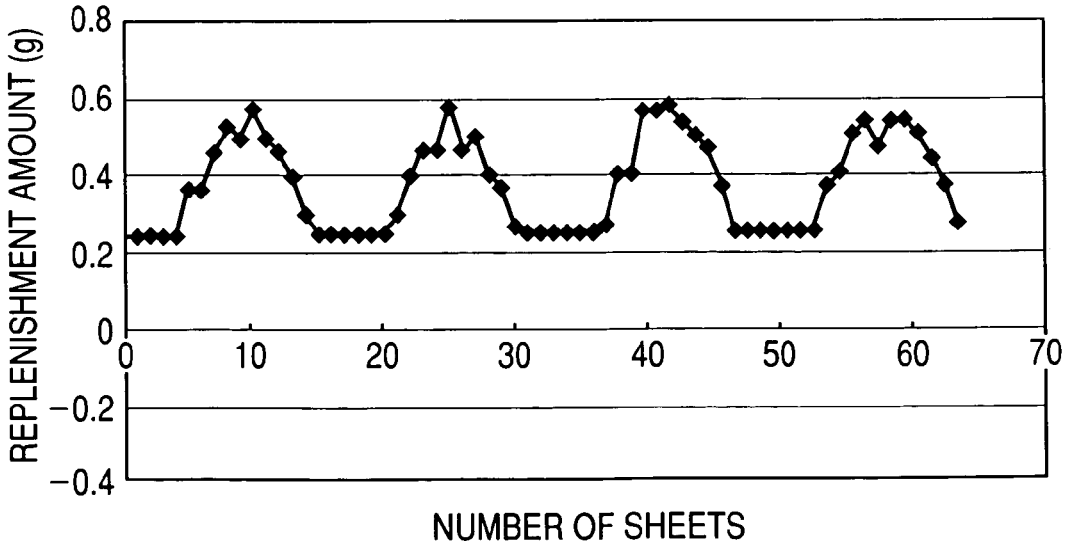
FIG. 10 is a graph showing a toner replenishment transition immediately after the density of the original becomes thick in the case where the present invention is applied.
Figure 11:
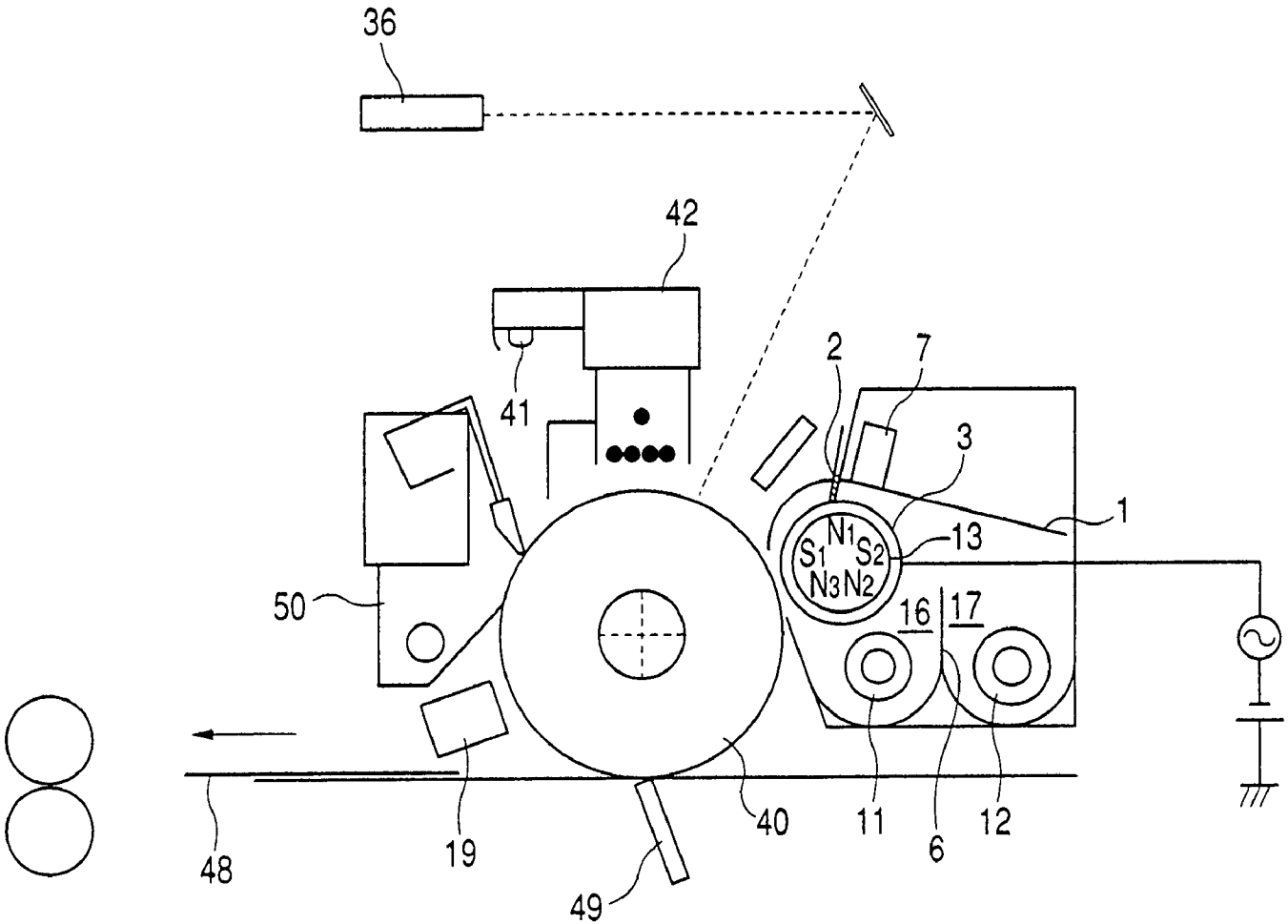
FIG. 11 PRIOR ART
FIG. 11 is a schematic view of a conventional image forming apparatus.

FIGS. 9 and 10 show results of forming the image as described above.

FIGS. 9 and 10 show density transitions and replenishment amount transitions when feeding 200 A3-sized sheets for 5% images and thereafter feeding 64 A3-sized sheets for 70% images.

A toner density target value is controlled so that the density on the photosensitive drum 40 becomes fixed throughout since the initial stage, and a replenishment amount determined to reach this toner density target value is properly modified according to the density of the original. This contrivance enables the stable transitions to be obtained by educing undershoots or overshoots of the density and the replenishment amount. It is also possible to restrain the replenishment deflection due to a difference in distance between the toner density detection means 7*a* and the replenishment screw 62 and to attain the stable density transitions. Still further, the density of the toner image can be kept permanently fixed by detecting the density on the photosensitive drum 40.

Note that if the toner density is set equal to or larger or smaller than a certain level, a toner overflow/coat deteriorated phenomenon might be induced. This problem can be solved by providing a threshold value of a certain toner density level. Namely, just when the signal under the developer reflection ATR reaches the threshold value, the control from the patch detection ATR is halted, and the replenishment is switched over to the replenishment only under the developer reflection ATR. Target values of the developer reflection ATR on this occasion may be fixed to the upper and lower limit values. Then, when making a request for such a direction that the signal from the patch detection ATR falls within the threshold value, the target values of the developer reflection ATR are changed, whereby the preferable density transitions are acquired.

Second Embodiment

A second embodiment is an exemplification in which the control for changing the target value of the toner density under the patch detection ATR is contrived more suitably for the present invention.

In the case of the control exemplified in the first embodiment, when continuing to detect that the density on the photosensitive drum 40 is thin, the target value of the toner density rises continuously. As a result of this, the toner replenishment amount increases but is not beyond the replenishment amount permissible range shown in FIG. 8. Therefore, when frequently activating the patch detection ATR and so on, the target value of the toner density rises, however, there occurs a state where the actual toner density does not increase so much. Next, when detecting that the density on the photosensitive drum 40 is thick, the toner target density decreases. Since the target value of the toner density excessively rises, however, the toner target density, even though decreased, is still higher than the actual toner density, and it follows that a large amount of toner is to be continuously replenished for a while, with the result that the density becomes too high. For avoiding such a phenomenon, if the result of the patch detection ATR is the same as the target density (the initial density), the toner target density is set to the toner density at the present time.

Specifically, the preceding result of the patch detection ATR is compared with the result of this time, and, when changed from "thick" to "thin" or from "thin" to "thick", the toner density at the present time is judged ideal. Then, the target value of the toner density is set to the toner density at that time.

The density setting being thus done, it is feasible to avoid the problem that the deteriorated control occurs due to a dispersion of the toner density target value as described above, and to attain the preferable density transitions.

Further, it is more preferable to control so that if changed from "thick" to "thin", the toner density target value is set as the (actual) toner density only when the (actual) toner density is higher than the toner density target value, and, whereas if changed from "thin" to "thick", the toner density target value is set as the (actual) toner density only when the (actual) toner density is lower than the toner density target value.

This is because if the toner density target value decreases in spite of changing from "thick" to "thin", a much thinner phenomenon appears. It is therefore desirable to change only in such a direction as to increase the toner density target value.

Third Embodiment

A third embodiment is an exemplification of modifying (improving) inconvenience caused due to the use with a delay by one sheet since the signal from the video count C1 does not catch up with.

After reading an original 31, as described above, the original signal is converted into the laser drive signal by use of the image signal processing circuit 34 and the pulse width modulation circuit 35. After all the conversions for the target original 31 have been finished, a calculation value is obtained by the counter 66. The signals are, however, sequentially transmitted to the laser 36 while performing the conversions, thus forming the image. Therefore, almost simultaneously with the end of the image formation involving the use of the laser 36, the calculation value by the counter 66 is obtained. Accordingly, when the present invention is applied, the replenishment amount permissible range acquired by performing the calculation from the video counter C1 is employed for the next image formation. In such a case, if the small-sized paper is fed through after forming the image with the high density on the large-sized paper, it follows that the replenishment amount obtained based on the high-density on the large-sized paper is used for the replenishment to the small-sized paper, and hence the replenishment time is deficient. For avoiding this inconvenience, taking a period of possible-of-replenishing time for every paper size into consideration, if the possible-of-replenishing time is less than a period of replenishment command time, the toner is replenished only for the possible-of-replenishing time, and a deficient amount is additionally replenished when forming the image next time.

With this contrivance, the preferable density transitions are acquired without any deficiency of the replenishment time.

Fourth Embodiment

A fourth embodiment is an exemplification of detecting-the toner density by utilizing not the aforementioned optical ATR sensor but a system (inductance ATR) for detecting magnetic permeability of the magnetic carrier of the developer in the developing device 44.

The inductance ATR detects the magnetic permeability of the magnetic carrier contained in the developer in the developing device 44. Flowability of the toner contained in the developer and a frictional electrostatic amount (triboelecricity) change due to an abrupt change in the toner replenishment amount, alteration of the magnetic carrier contained in the developer and environmental fluctuations, and a volume density of the developer changes. In this case, a defect is that the magnetic permeability of the magnetic carrier cannot be correctly measured. Therefore, as in the present invention, the toner replenishment amount is controlled in accordance with the image density only within the proper range, thereby enabling avoidance of the toner replenishment amount deflection due to the aforementioned measuring defect. The toner density detection based on the inductance ATR is also preferable for a sensor employed in the present invention.

Fifth Embodiment

Effects of the present invention can be exhibited also when applied to a printer connected via a network to a so-called personal computer that use pre-computerize image signals with no original, i.e., an image forming apparatus for forming the image on the basis of image information data, inputted via a cable, from which an desired image is formed.

According to each of the embodiments discussed above, it is possible to stabilize the toner density transition occurred as a concomitant of the scatter in the toner replenishment amount when controlling the toner-to-carrier ratio at a fixed level and to prevent the image density from being deteriorated due to the occurrence of triboelectricity deficiency (deficiency in electrostatic amount) in the replenished toner.

This application claims priority from Japanese Patent Application No. 2003-330058 filed Sep. 22, 2003, which is hereby incorporated by reference herein.

What is claimed is:

1. An image forming apparatus comprising:

electrostatic image forming means for forming an electrostatic image corresponding to image information on an image bearing member;

developing means for developing the electrostatic image with a toner, said developing means including a developer container for accommodating a developer containing the toner and a carrier;

toner density detection means for detecting a toner density in said developer container;

toner replenishment amount control means for controlling an amount of the toner which is replenished to said developer container in accordance with a result of a detection by said toner density detection means, wherein said toner replenishment amount control means performs a control function such that the amount of the toner is maintained at a value equal to or larger than a replenishment amount lower limit value and equal to or smaller than a replenishment amount upper limit value; and changing means for changing the replenishment amount lower limit value and the replenishment amount upper limit value according to the image information.

2. An image forming apparatus according to claim 1, wherein said toner replenishment amount control means calculates a toner replenishment amount target value for toner replenishment control on the basis of a result of a detection by said toner density detection means and a toner density reference value, wherein said toner replenishment amount control means performs a control function with the calculated toner replenishment amount target value when the calculated toner replenishment amount target value falls in a range equal to or larger than the replenishment amount lower limit value and equal to or smaller than the replenishment amount upper limit value, wherein said toner replenishment amount control means performs a control function with the replenishment amount lower limit value as the toner replenishment amount target value when the calculated toner replenishment amount target value is smaller than the replenishment amount lower limit value, and wherein said toner replenishment amount control means performs a control function with the replenishment amount upper limit value as the toner replenishment amount target value when the calculated toner replenishment amount target value is larger than the replenishment amount upper limit value.

3. An image forming apparatus according to claim 2, further comprising image density detection means for detecting a density of and image for a density detection that is a formed image bearing member wherein said toner replenishment amount control means changes the toner density reference value in accordance with a result of a detection by said image density detection means.

4. An image forming apparatus according to claim 3, wherein said toner replenishment amount control means changes the toner density reference value on the basis of the result of a detection by said image density detection means and an image density reference value.

5. An image forming apparatus according to claim 4, wherein said toner replenishment amount control means sets the result of a detection by said toner density detection means at the present time as the toner density reference value when the result of a detection at the present time by said image density detection means is larger than the image density reference value, and when the result of the detection of a last time by said image density detection means is smaller than the image density reference value, alternatively when the result of a detection at the present time by said image density detection means is smaller than the image density reference value, and when the result of the detection of the last time by said image density detection means is larger than the image density reference value.

* * * * *

UNITED STATES PATENT AND TRADEMARK OFFICE

CERTIFICATE OF CORRECTION

PATENT NO. : 7,050,729 B2
APPLICATION NO. : 10/935187
DATED : May 23, 2006
INVENTOR(S) : Fujiwara It is certified that error appears in the above-identified patent and that said Letters Patent is hereby corrected as shown below:

COLUMN 16:
Line 37, "and" should read --an--.
Line 38, "a formed" should read --formed on the--.

Signed and Sealed this

Twenty-sixth Day of December, 2006

JON W. DUDAS
*Director of the United States Patent and Trademark Office*